United States Patent [19]

Hiner et al.

[11] 4,080,753

[45] Mar. 28, 1978

[54] SIGNAL GENERATING FLYING SAUCER WITH THIN CENTRAL VIBRATILE PORTION

[76] Inventors: William D. Hiner, 5512 Floyd, Amarillo, Tex. 79106; Jimmy E. Hughes, 5017 W. 57 St., Amarillo, Tex. 79109; Tommy J. Slaughter, 2002 Iris, Amarillo, Tex. 79107

[21] Appl. No.: 781,858

[22] Filed: Mar. 28, 1977

[51] Int. Cl.[2] ..... A63H 33/26; A63H 27/00

[52] U.S. Cl. ..... 46/227; 46/74 D; 46/228; 273/106 D

[58] Field of Search ..... 46/74 D, 74 R, 75, 232, 46/227, 228; 273/106 X D

[56] References Cited

U.S. PATENT DOCUMENTS

| | | | |
|---|---|---|---|
| 2,826,860 | 3/1958 | Ashley et al. | 46/74 D X |
| 3,191,344 | 6/1965 | Yagjian | 46/228 |
| 3,359,678 | 12/1967 | Headrick | 46/74 D |
| 3,394,491 | 7/1968 | Valentine | 46/227 |
| 3,531,892 | 10/1970 | Pearce | 46/228 |
| 3,710,505 | 1/1973 | Linenfelser | 46/74 D |
| 3,798,834 | 3/1974 | Samuel | 46/228 |
| 3,900,986 | 8/1975 | Torres | 46/74 D |
| 3,948,523 | 4/1976 | Michael | 273/106 B |

*Primary Examiner*—F. Barry Shay
*Attorney, Agent, or Firm*—Ely Silverman

[57] ABSTRACT

Sturdy spinning and flying toy with audible sound producing means reliably and automatically performing at full volume only when the toy is operatively airborne and being simple and safe and self-contained for operation by a child. The toy comprises an outer shell assembly and a sound producing assembly; the outer shell assembly in turn comprises a thin central vibratile portion and a peripheral downwardly projecting skirt; a downwardly open shell chamber is enclosed within the outer shell assembly; the sound producing assembly is attached to the top central portion of the shell assembly and the central portion of the shell assembly provides for enhancing the audible sound characteristics of the sound producing assembly.

6 Claims, 14 Drawing Figures

FIG.4
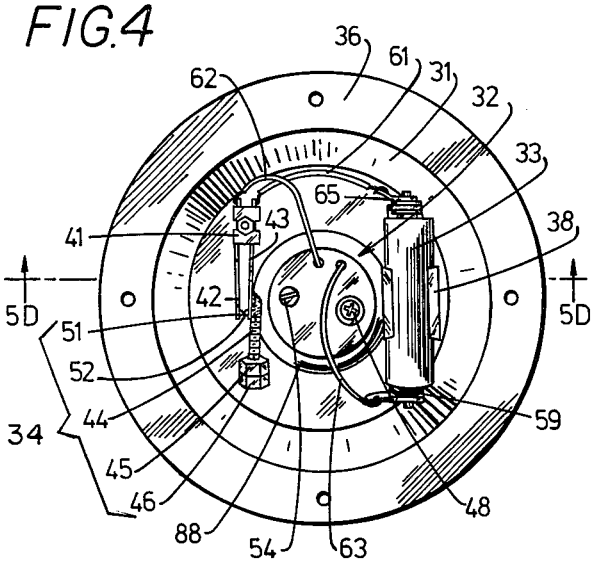
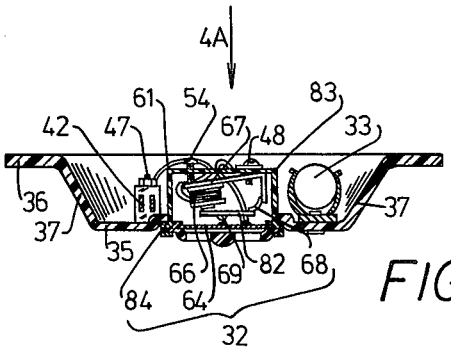
FIG.5
FIG.6
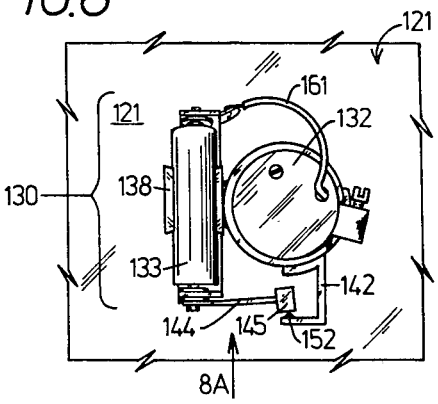
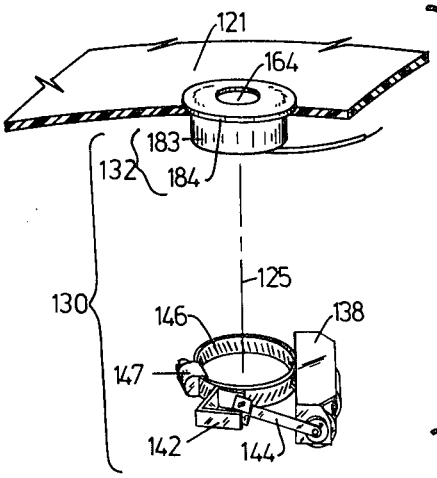
FIG.7
FIG.9
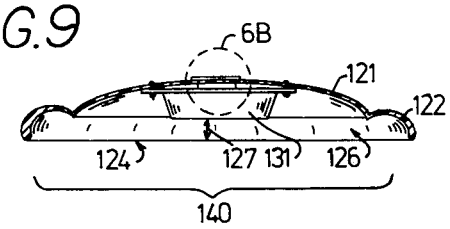
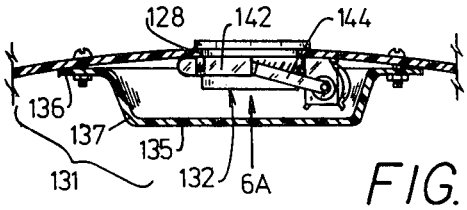
FIG.8

SIGNAL GENERATING FLYING SAUCER WITH THIN CENTRAL VIBRATILE PORTION

BACKGROUND OF THE INVENTION

1. Field of the Invention

The field of art to which this invention pertains is aerial toys of the flying saucer type.

2. Description of the Prior Art

In the prior art toys that reliably made noises loud enough to be enjoyed by a child and looked like flying saucers as in U.S. Pat. No. 2,826,866 were not able to fly and such deficiency in performance was a serious detrement to a child's enjoyment thereof. Flying saucer like toys that did fly as in U.S. Pat. No. 3,359,678 did not make such loud noises and constituted a hazard when flown in crowded parks and like play areas.

While such toys simulating noise and appearance of space travel have been desired as shown in U.S. Pat. No. 2,826,860 the sound producing aspect has been deemed to require apparatus that was sufficiently heavy to preclude its ability to fly or/operation with repeated falls from height usually carried by a child.

The application of some of such structures as herein has been inhibited because of lack of appreciation of the feasibility of cooperative combination of some of features of each of such apparatuses with modifications thereby and additions thereto to produce effects heretofore not accomplished.

SUMMARY OF THE INVENTION

The apparatuses disclosed are arranged to not create any audible sound until a predetermined minimum angular or rotational velocity is reached.

The top central portion of the shell which provides for maintaining the apparatus airborne enhances the audible sound characteristics of the sound producing means while a heavy skirt and deep rim portion selectively filters the audible sound broadcasted by the combination as well as provides a strong structure for manipulating the apparatus during launching and provide an impact absorbing member during landing of greater strength than needed for flying.

BRIEF DESCRIPTION OF THE DRAWINGS

FIG. 4 is a view of the sound producing assembly 30 taken along the direction of the arrow 4A of FIG. 5.

FIG. 5 is a transverse cross-section view through the section 5D—5D of FIG. 4.

FIG. 6 is a plan view of another assembled sound-producing structure according to this invention located in Zone B of FIG. 9 as seen along direction of arrow 6A in FIG. 8.

FIG. 7 is an exploded view of the components of the assembly shown in FIG. 6 showing such components in oblique view.

FIG. 8 is a view along direction of arrow 8A of FIG. 6 showing the components of FIG. 7 in assembled condition.

FIG. 9 is a diametral sectional view of embodiment 140 of apparatus according to the invention incorporating the assembly of FIGS. 6–8.

Dimensions of apparatus 40 are set out in Table I.

FIG. 4 is drawn to scale to illustrate the dimensions of this apparatus 40.

Figure 1:
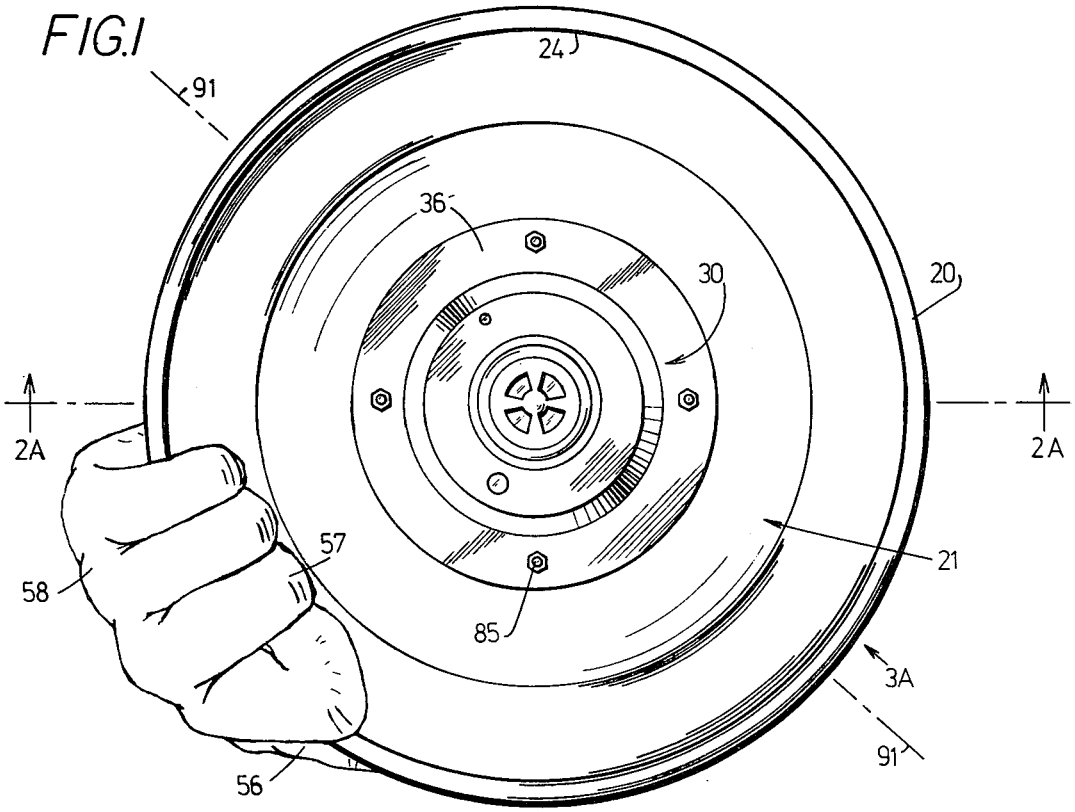
FIG. 1 is a top view of apparatus 40 taken along the direction of arrow 1A of FIG. 2 with an operator's hand shown.
Figure 3:
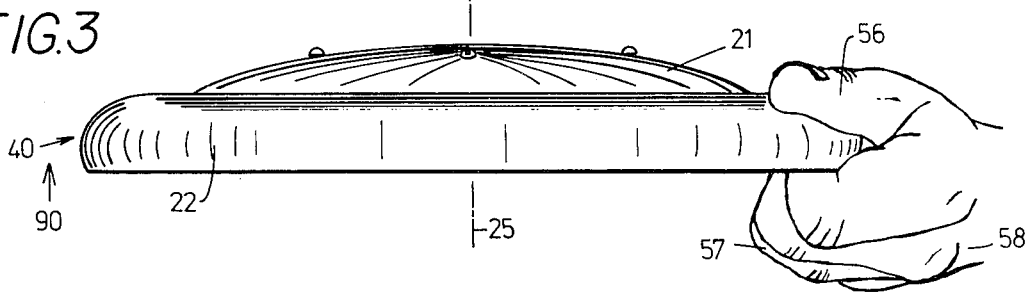
FIG. 3 is a side view of the apparatus 40 taken along the direction of the arrow 3A of FIG. 1.

FIGS. 1 and 3 are drawn to the same scale, but at different scale than in FIG. 4.

DESCRIPTION OF THE PREFERRED EMBODIMENTS

Figure 10:
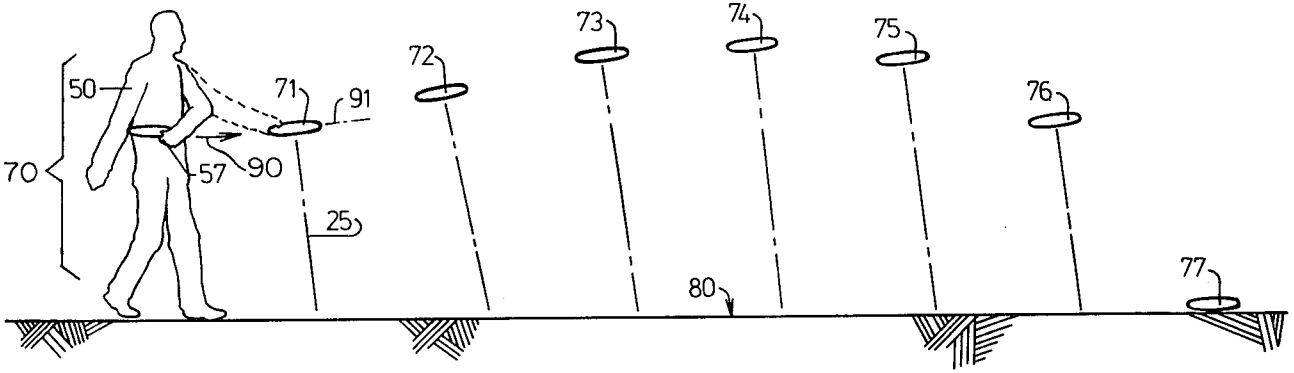
FIG. 10 is a diagrammatic side view of the sequence of positions of apparatus 40 while in operation.
Figure 11:
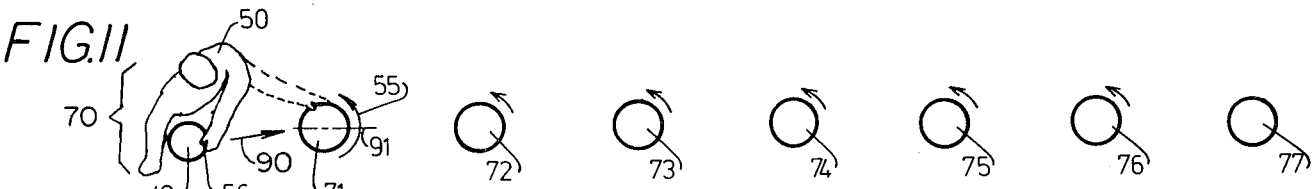
FIG. 11 is a top view of the operation shown in FIG. 10.
Figure 13:
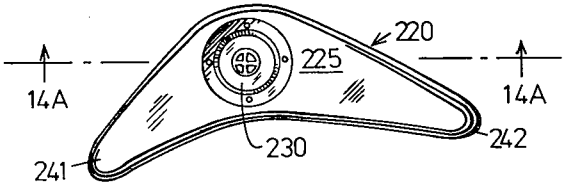
FIG. 13 is a bottom view of another apparatus according to this invention.
Figure 14:
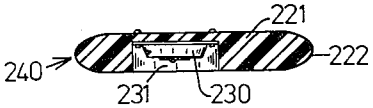
FIG. 14 is a vertical sectional view along section 14A—14A of FIG. 13.

The apparatus 40 according to this invention comprises a circular outer shell assembly 20 and a sound producing assembly 30. In operation the apparatus 40 is manipulated by an operator as 50 as shown in FIGS. 10 and 11 to project the apparatus through the air while also spinning the apparatus in a direction having a horizontal component.

The outer shell assembly 20 comprises a (a) central section 21 in the shape of a sector of an upwardly convex dome and is thin and vibratile and (b) a peripheral ring portion 22 in the shape of an axially symmetrical upwardly convex top portion of a hollow torus to which is attached (c) the top end of a rugged cylindrical skirt 23 which skirt terminates at its lower edge in a circular rim 24. A major or shell chamber 26 is formed within the outer shell assembly 20. The portions 21, 22, 23 and 24 are co-axial and axially symmetrical about a common central vertical longitudinal axis 25.

The parts 21–24 of the casing are firmly joined together and formed of a sturdy material as polyethylene so that the assembly 20, while dimensionally stable is sufficiently flexible and strong to usually absorb mechanical shocks that might otherwise do damage to assembly 30 and its components.

The sound producing assembly 30 comprises in operative combination, a central case assembly 31, a buzzer 32, an electrical source or battery 33, and a centrifugal sensor means 34 sensitive to the rotation speed of the overall apparatus 40. The central casing assembly 31 has a floor 35, wall 37, and shoulder 36; the electrical components 32, 33, and 34 of the sound producing assembly 30 are fixedly attached to casing floor 35. The rigid wall 37, shaped like the frustum of a cone, is firmly attached at its bottom to the floor 35 and at its top to a casing shoulder 36, in the shape of a flat ring. The shoulder 36 is firmly attached by connecting members as bolts 39 to the center portion 21 of the casing assembly 20, to form releasable connections therebetween.

The sound producing assembly 30 comprises an electrically insulating base 41 fixed to the floor 35. Fixed end of each of switch arms 42 and 43 are fixed in the base 41; the fixed switch arm 42 is provided with an electrical contact 51 at the free end of that arm, and a spring loaded movable switch arm 43 is provided with a contact point 52 fixed thereon near to the free end of that arm. Also, there is firmly attached to arm 43 near to its free end a rigid screw 44. A pair of nuts threadedly fit on screw 44 and are firmly held at any predetermined position —45 serving to join nut 46 for a firm positioning of both on the threaded shaft. The spring (resiliently flexible) arm 43 and the weight (1/10 oz.) provided by the movable nuts 45 and 46 comprise means sensitive to the rotation of the apparatus 40. Nuts 45 and 46 provide means for adjusting the inertial mass of arm 43.

At rest position of the apparatus 40, the contacts 52 and 53 are open, i.e. base 41 and arms 42 and 43 and their contacts form a normally open switch. On sufficiently rapid rotational speed of the apparatus 40, the free end of the resilient arm 43 which supports the adjustment arm 44 and weights 45 and 46 is moved radially and the contacts 51 and 52 on arms 42 and 43 respectively, are closed.

Buzzer assembly 32 is a typical electromagnet buzzer, such as Catalogue No. J4-810 of Calectro® model made by G. C. Electronics, Rockford, Ill., which is activated by closing of the electric circuit from battery 33 through the contacts 51 and 52.

On closure of contacts 51 and 52, electric circuit is passed from terminal 65 of the battery 33 along wire 61 from the battery terminal to switch arm 43 and along wire 62 from arm 42 to the armature coil 66 of buzzer assembly 32, and thence to rigid connector bracket 67, and thence across a resilient contact arm portion 68 to an electromagnetically susceptible and electrically conductive arm 82; thence to a contact 69 on arm 82; thence to an electrical contact on vibrator plate 64; thence from plate 64 by wire 63 to battery terminal 59. Whereupon the plate 82 on arm 68 is drawn toward the core of the coil 66 and the circuit to the battery is broken, following which the magnetic coil 66 releases the arm 82 which, because of resilient action of arm 68, resiliently returns to extended position and the contact 69 strikes the contact on plate 64 and causes the plate 64 to vibrate and the electrical cycle above described to repeat. A screw 48 holds bracket 67 to casing 83 and adjustment screw 54 is threadedly attached to casing 83 and to bracket 67 and controls the distance between contacts on arm 82 and plate 64 as well as the tension in the resilient support 68 and so controls the overall frequency of vibration of plate 64. Plate 64 is held to the casing 83 by an electrically insulating ring 84 held in a hole 88 in floor 35.

For operation of the apparatus 40 nut 45 is located on rod 44 to provide the predetermined minimum rate of rotation of apparatus 40 about its axis 25 at which the buzzer assembly 32 will be connected to battery 33 and nut 46 is used to lock lock nut 45 in position on rod 44 by jamming nut 46 against nut 45. The sound producing assembly 30 is then affixed to the peripheral assembly 20. The movable arm 43 is then firmly held in position in assembly 31 with the contact points 51 and 52 open or spaced away from each other when apparatus 40 is at rest or not spinning about its axis 25.

In operation of apparatus 40, an operator 50 initially holds apparatus 40 by its skirt portion and rim with thumb as 56 on top of shell portion 22 and fingers as 57 of the operator's hand 58 in the chamber 26. The operator 50, shown as left handed in FIGS. 1, 10 and 11 throws the apparatus 40 through the air as shown in FIGS. 10 and 11 and thus rotates apparatus 40 in the counterclockwise direction 55 around its axis 25 as well as propelling the apparatus 40 at a velocity of translation movement of about 16 ft per second for the first 10 feet of travel. Upon reaching the predetermined rotational velocity of apparatus 40, usually 5 revolutions per second, the nuts 45 and 46, usually held in position as shown in FIG. 4, with movable contact 52 spaced away from fixed contact 51 are moved radially against the resilient positioning action of the resilient arm 43. While flights of apparatus 40 lasts usually from 3 to 10 seconds, an illustrative flight of 60 feet of the apparatus 40 and lasting about 6 seconds is shown in FIGS. 10 and 11. As there shown the apparatus 40 is moved from a starting position 70 to a release position 71 while it is held in the operator's hand. While it is held in the operator's hand, it has a neglible angular rotation although it does reach a substantial linear velocity immediately prior to leaving the operator's hand at position 71.

In the exemplary and usual operation of the apparatus 40, the apparatus 40 travels upwards for a height of about 10 feet in the exemplary embodiment and horizontally about 60 feet from position as 71 to 72 to 73 to 74 to 75 to 76 to 77 as shown in FIGS. 10 and 11. In the exemplary showing these positions 71–77 are each 10 feet apart and have somewhat varied height. The height increases from position 71 to position 73 and then is fairly level at following positions 73–74–75 and at following positions 75–77 is lower, contacting the ground at position 77. In the exemplary embodiment the time for the apparatus 40 to traverse each increment of distance is substantially constant for the first half of the flight, i.e. from positions 71–74 where the speed is initially about 16 feet per second although the time for traverse of similar distance increases substantially (50 to 100 percent, to a speed of 5 to 10 feet per second) in the later stages such as 75–77. The sound produced by the sound producing assembly 30 does not change in intensity or tone once the apparatus 40 has reached the minimum rotational velocity to close the contacts 51 and 52.

The sound generated by the apparatus 40 is focused and filtered by the shell assembly 20 (as below described) to improve the quality as well as the directional characteristics of the apparatus.

Figure 12:
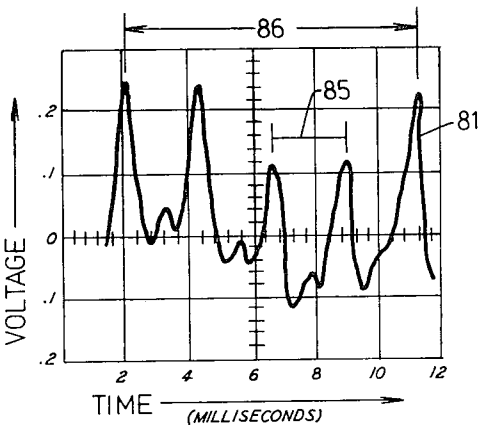
FIG. 12 is a diagrammatic presentation of an oscilligraph record of the sound made during an operation of the apparatus 40.

The sound generated by the buzzer is constant at 428 c.p.s. with a minimum of unpleasant high tones usually associated with metallic buzzers because the wide and flexible dome 21 and curved wall 22 in the airborne structure of shell assembly 20 has an intermodulation distortion effect which absorbs the higher frequencies while broadcasting the lower frequency radiation. As shown in FIG. 12 an oscillograph tracing of the sound produced by apparatus 40 was made by making a magnetic tape recording of the sound made by apparatus 40 while in flight and feeding the output of such tape record into a type 564B oscilliscope with type 3A 72 Dual trace amplifier (Ser. No. 012146) and type 363 time base (Ser. No. 012359) manufactured by TEKTRONIX of Portland Oregon, U.S.A. FIG. 12 shows at 2 milliseconds per horizontal division and 0.1 volt per vertical division the waveform 81 of the sound broadcasted by apparatus 40: it has a relatively simple form and a principle medium range audible frequency (428 c.p.s), shown as 85 and a secondary low frequency of about 100 c.p.s. shown as 86; the usual harsh high frequency tones of mechanical buzzers when operated along are substantially reduced or absent from waveform 81. Any slight effect due to the rotation of the mechanically imperfectly balanced apparatus 40 is interposed on top of the sound emanation but is inaudible to the human ear (except as below described in regard to the wobble effect). The curved surfaces 21 also provide a focusing effect as well as a filtering effect: the focusing effect directs the audible sound broadcasted principally at the ground along the line of the central longitudinal axis 25 of apparatus 40.

Application of an oscillatory motion to apparatus 40 during launching as at position 70 and 71 in direction of arrow 90 about an axis as 91 which axis 91 extends transverse to axis 25 and parallel to the flat plane of edge 24 produces a "wobble" effect in the apparatus 40 during its flight about such axis 91 and, because of the focusing effect of the sound along axis 25, a magnitude variation of "wobble" effect on the sound heard by an observer and/or audience of the operation of apparatus 40. By this apparatus, a flying apparatus is provided which looks like a ship from outerspace and also makes a pleasant sound and further may be readily flown through the air. The apparatus 40 is arranged so that it does not create any sound until a predetermined minimum angular or rotational velocity is reached.

The sound produced by apparatus 40 has a volume of a shout at 10 feet and is clearly audible at 100 feet during flight; quantitatively, (in regard to a level of 0.0002 microbar as a threshold of hearing) the sound produced by the apparatus 40 in flight as in FIGS. 11 and 12 ranges from 90 to 100 decibels and is usually constant at 90 decibels.

Figure 2:
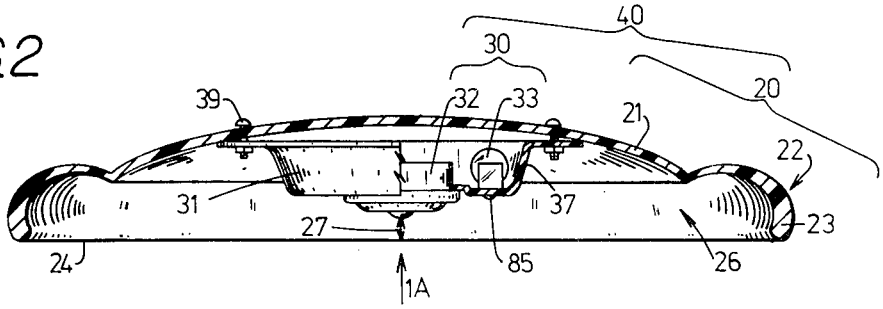
FIG. 2 is a transverse cross-sectional view taken along the diametral vertical section 2A—2A of FIG. 1.

While electric batteries are regarded as heavy yet fragile structures, by the structure herein provided the battery 33 is firmly supported in brackets 38 in case 31 in such a manner, as shown in FIGS. 2 and 4 that, even when the entire structure 40 strikes the ground 80 as at 77, because the shell structure 20 is composed of resilient and bendable curved shell structure 21 which is made further resilient by the attachment to resiliently bendable torus structure 22 it protects the assembly 30 on contact with the ground as 80 by the extension of the lip 24 below the skirt 23 by vertical extent of the space 27 between the bottom of the assembly 30 and the lip 24, as well as that lip 24 extends radially from edge of assembly 30 as well as its center for equal distances in all directions.

The central portion 21 of the shell 20 which provides for maintaining the apparatus 40 airborne thus enhances the audible sound characteristics of the sound producing means 30 while another portion thereof, the heavy skirt 22 and deep rim, selectively interferes with broadcase of some audio frequencies and thereby selectively filters the audible sound broadcasted by the combination of assemblies 20 and 30 as well as that the same heavy but flexible skirt and portion 22 provides a strong structure for manipulating the apparatus 40 during launching as at positions 70 and 71 and, during landing, at position 77, provides an impact absorbing member of greater strength than needed for flying. The large size of the skirt and its strength allow the operator 70 to firmly grasp the apparatus 40 and to spin it. The bottom of casing 31 (and 131) is spaced by a distance 27 over the level of the bottom or rim 24 of skirt or ring 23 so that the sound assembly 30 is protected by assembly 20 from contact and impact with ground 80 when landing as at position 77 by such spacing as well as by the impact absorption of the large vibratile and flexible portion of the dome or central curved portion between rim 24 and assembly 30.

As shown in FIG. 4 (and 6) the buzzer 32 (and 132) is centrally located on axis 25 of shell assembly 20 but the battery is not.

The resulting eccentric location of the center of gravity of the sound producing means 30 does not interfere with the flying characteristics of apparatus 40 because the effect of its eccentric location is negligible as the apparatus 40 or 140 spins at only 4 to 8 revolutions per second although it travels fast enough to fly which is only 10 to 20 miles per hour linearly or in a translational movement.

Even a strong man can not make the subject apparatus 40 rotate at more than 9 revolutions per second; yet this has no effect on the sound generated by the apparatus as 40 compared to when it operates at a frequency, such as 6 revolutions per second, which is over the minimum required to initiate the closure of the switch elements 44 and 45.

The light battery has adequate power in view of the short flight times and lack of waste of power when the apparatus 40 is not in flight and the relatively short time of flight of apparatus 40, in relation to the total time that the apparatus 40 is used by its owner.

The apparatus 140 comprises the assembly 130 and 120. These assemblies cooperate as do assemblies 20 and 30 in apparatus 40 and apparatus 140 and its components operates as do corresponding components in apparatus 40 although apparatus 140, especially in regard to components of sound producing assembly 130 has manufacturing advantages. Assembly 120 comprises the same shell components 121, 122, 124, 126 and 127 as components 21, 22, 24, 26 and 27 respectively of apparatus 40 except for a lack of a hole in portion 21 and the presence of a hole 128 in sheet portion 120.

The sound producing assembly 130 is composed of a battery 133, buzzer assembly 132 like battery 33 and buzzer 132 respectively of apparatus 40, a bracket 138 and a centrifugal switch unit. The casing 183 of assembly 132, corresponding to casing 83 of assembly 32 fits into a hole 128 in shell 120 at the central longitudinal axis 125 of apparatus 140, about which shell 120 and 130 are axially symmetrical. Battery bracket 138 is attached to a clamp strap 146 and a clamp tightener 147 is arranged to firmly attach to shell 183 of buzzer 132; the bracket 138 also supports a flexibly movable arm 144 with a weight 145 thereon that is sensitive to the rotation of apparatus 140 and, on rotation of apparatus 140 about its axis 125 an electrical contact at 152 completes a circuit with a fixed arm 142 that is fixed to the metallic bracket 138; the clamp 142 and shell 183 and wire 162 operatively connect (like wires 61 and 62) the coil of the buzzer and the battery 133. Bracket 138 supports battery 133.

The apparatus 240 comprises a sound producing assembly 230 enclosed in a casing such as 31 in a boomerang or L-shaped exterior shell 220. The exterior shell 220 comprises a left hand portion 241 and a right hand portion 242 of conventional boomerang shape. The shell of the boomerang shaped apparatus is solid top to bottom and has an upwardly convex center portion 221 connected to a downwardly extending edge portion 222 (like 22) which terminates at a peripheral bottom edge 224 (like 24). The bottom as 235 of the shell 231 (in which is the chamber the sound producing assembly 230) is located above the level of the bottom surface 224 of the shell unit 220 by a small distance 227 (like 27).

The assembly 230 generates sound in the same manner as above described for the assembly 30 and is operated in generally the same manner as above described for the apparatus 41 as shown in FIG. 10.

TABLE I:

| DIMENSIONS OF APPARATUS 40 | | |
|---|---|---|
| Item | Measurement | Metric Equiv. |
| Weight of outer saucer shell (21, 22, 23) | 3-1/2 oz | 99 g |
| Weight of buzzer 32 | 3/4 oz | 21.3 g |
| Weight of buzzer plus inner shell (35, 36, 37) | 2-1/4 oz | 63.8 g |
| Inside diameter of outer saucer shell (24) | 8-7/8 in. | 22.5 cm |
| Outside diameter of outer saucer shell (22) | 9-1/2 in. | 24.1 cm |
| Vertical height from 24 to top of 21 | 1-1/8 in. | 2.8 cm |
| Thickness of shell 21 | .040 in. | 0.10 cm |
| Diameter of inner shell 35 | 5-1/16 in. | 12.9 cm |
| Height of inner shell 35–36 | 3/4 in. | 1.9 cm |
| Outside diameter ring 36 | 5-1/16 in. | 12.9 cm |
| Inside diameter ring 36 | 3-1/2 in. | 88.9 cm |
| Thickness of floor 35 | .08 in. | 0.20 cm |
| Radial thickness of skirt 23 | 1/4 in. | .64 cm |
| Weight of Battery 33 (size AA, 1.5 v) | 3/4 oz | 21.3 g |

We claim:

1. A flying toy with audible sound producing means comprising a circular outer shell assembly and a sound producing assembly, the outer shell assembly comprising a thin central vibratile portion and a peripheral skirt, said central portion being attached to the top end of said peripheral skirt, said skirt being thicker than said central portion of said shell and said skirt terminating at a lower edge thereof in a circular rim and a shell chamber being enclosed within said outer shell assembly and said outer shell assembly being axially symmetrical about a common central vertical axis, the sound producing assembly comprising, in operative combination a central case assembly, a buzzer, a battery, and a centrifugal motion sensor means sensitive to the rotational speed of said outer shell, and said buzzer, said battery and said sensor being located in said central case assembly, said central case assembly comprising a casing located in said shell chamber between the top of said central portion and said rim at the lower edge of said skirt and above said rim, said casing being fixed to said outer shell and said casing being axially symmetrical about said axis, said shell chamber being closed at its top by said shell assembly and having a bottom opening bounded by said circular rim and said outer shell assembly extending over and peripherally of said central case assembly equally in all directions, said central portion providing means for enhancing the audible sound characteristics of the sound producing assembly.

2. Apparatus as in claim 1 wherein the sound producing assembly comprises a fixed switch arm with an electrical contact on a free end of that arm and a resiliently mounted movable switch arm is provided with a contact point near to the free end of that movable switch arm and the contacts form a normally open switch at rest position of said apparatus and the free end of the movable arm is resiliently movable transverse to said common central vertical axis.

3. Apparatus as in claim 2 wherein the central case assembly has a floor, a side wall and a shoulder, said floor joined to said shoulder by said side wall, said shoulder joined to said central portion of said outer shell assembly, and said buzzer and battery and sensor are fixedly attached to said case floor.

4. Apparatus as in claim 2 wherein the central case assembly has a floor and a side wall and said side wall is joined to a shoulder and said shoulder is joined to said central portion of said outer shell assembly and said buzzer and battery and sensor are fixedly attached to said central portion of said outer shell assembly.

5. Apparatus as in claim 2 wherein said buzzer is located at the common central vertical axis and said battery and sensor are located at a position transversely spaced therefrom.

6. Apparatus as in claim 5 wherein said thin central portion of the outer shell assembly is in the shape of a sector of an upwardly convex dome, and said outer shell assembly also comprises a peripheral ring portion in the shape of an axially symmetrical upwardly convex portion of a hollow torus, said peripheral ring portion being joined at its central portion to the periphery of said thin central portion, and said peripheral ring portion is attached to the top end of said peripheral skirt.

* * * * *